United States Patent [19]

Geiger

[11] Patent Number: 5,072,555

[45] Date of Patent: Dec. 17, 1991

[54] SUPER HIGH-RISE TOWER

[76] Inventor: David H. Geiger, Kirby La., Rye, N.Y. 10580

[21] Appl. No.: 420,585

[22] Filed: Oct. 12, 1989

Related U.S. Application Data

[63] Continuation-in-part of Ser. No. 276,456, Nov. 25, 1988.

[51] Int. Cl.[5] ..... E04B 1/32

[52] U.S. Cl. ..... 52/82; 52/148

[58] Field of Search ..... 52/152, 148, 146, 649; 343/874, 885

[56] References Cited

U.S. PATENT DOCUMENTS

| | | | |
|---|---|---|---|
| 423,067 | 3/1890 | Melber | 52/148 |
| 915,305 | 3/1906 | Newhall | 52/148 |
| 2,204,026 | 6/1940 | Peters | 52/148 X |
| 2,508,657 | 5/1950 | Toller-Bond | 52/148 X |
| 2,761,531 | 9/1956 | Anderson | 52/152 |
| 3,147,829 | 9/1964 | Johnson et al. | 52/152 |

FOREIGN PATENT DOCUMENTS

| | | | |
|---|---|---|---|
| 172139 | 7/1951 | Austria | 52/149 |
| 519606 | 6/1921 | France | 52/152 |
| 592085 | 7/1925 | France | 52/146 |
| 238622 | 7/1969 | U.S.S.R. | 343/874 |

*Primary Examiner*—David A. Scherbel
*Assistant Examiner*—Creighton Smith
*Attorney, Agent, or Firm*—Pasquale A. Razzano

[57] ABSTRACT

A super high-rise tower is disclosed which is formed from a central rigid core supported by a pretensioned cable network.

28 Claims, 13 Drawing Sheets

SUPER HIGH-RISE TOWER

RELATED APPLICATION

This application is a continuation-in-part of U.S. patent application Ser. No. 276,456 filed Nov. 25, 1988, the disclosure of which is incorporated herein by reference.

BACKGROUND OF THE INVENTION

The present invention relates generally to a super high rise tower for use as an observation platform and/or support for a super high rise antenna. In particular, the invention relates to a super high rise tower having a height of at least 400 meters above the ground and consisting mainly of a prestressed cable net adapted to resist wind and earthquake loads.

A number of world famous super high rise towers have been constructed in the past, including, for example the Tokyo Tower, the Eiffel Tower and the Moscow Tower. These towers are all of generally conventional construction using stacked steel frames and a truss configuration. Typically a prefabrication system is employed as the construction method for these towers, with the steel frames and other construction elements being sequentially lifted and hung by cranes, helicopters or the like for assembly.

Since a conventional high rise tower is constructed by stacking steel frames as a truss construction, when the structure is subjected to a horizontal load such as a wind load, the structure bends in the same direction as the load. A schematic illustration of this effect is shown in FIG. 1, which magnifies a model of a horizontal load Q and the amount of bending of a structure A when the wind load Q is applied to structure A. As seen therein, the structure A bends with the wind and thus deflects substantially at its top. In addition, the opposite sides of the structure are subjected to opposed stresses of tension and compression. As a result of this movement, conventional high rise towers are apt to shake or vibrate when subject to wind or earthquake loads. Such shaking affects the force-proof and earthquake-proof characteristics of the tower, e.g., extremity distortions and buckling will occur at the tension and compression sides of the tower, respectively. In addition, the swaying which will occur in the tower even under normal conditions will make use of the tower uncomfortable for people in the upper portions thereof. Thus, the vibration and swaying problems inherent in conventionally constructed towers prevent truly super high rise towers from being constructed.

Moreover, the conventional tower construction method which hangs steel frames and the other construction elements with cranes and helicopters is suitable for constructing only up to certain heights. At extreme heights working conditions are dangerous and it is very expensive using conventional techniques.

Accordingly, it is an object of the present invention to construct super high rise towers of 400 meters and more in height which will have improved wind and earthquake load resistance and reduced sway.

Another object of the present invention is to build super high rise towers efficiently and economically.

Yet another object of the invention is to build a super high rise tower using a prestressed cable network to reduce movements of the tower under load.

In accordance with an aspect of the present invention, a super high rise tower is provided which consists of a central core for supporting the weight of the tower and receiving the compression forces therein and a prestressed cable net around the core. Prestressing of the cable net reduces movements of the tower under wind and earthquake loads so that vibration and sway in the tower are substantially reduced as compared to conventionally constructed towers. Thus, the tower has improved wind force-resistance and earthquake-resistance characteristics are remarkably improved. As a result, it is possible to build a tower higher than with conventional techniques.

Of course, since the volume of steel used in towers of the present invention is significantly less than that of steel frame construction, it is much easier to process and assemble the tower and construction costs are remarkably reduced.

The above and other objects, features and advantages of the invention will be apparent to those skilled in the art from the following detailed description of illustrative embodiments thereof when read in connection with the accompanying drawings wherein:

Figure 1:
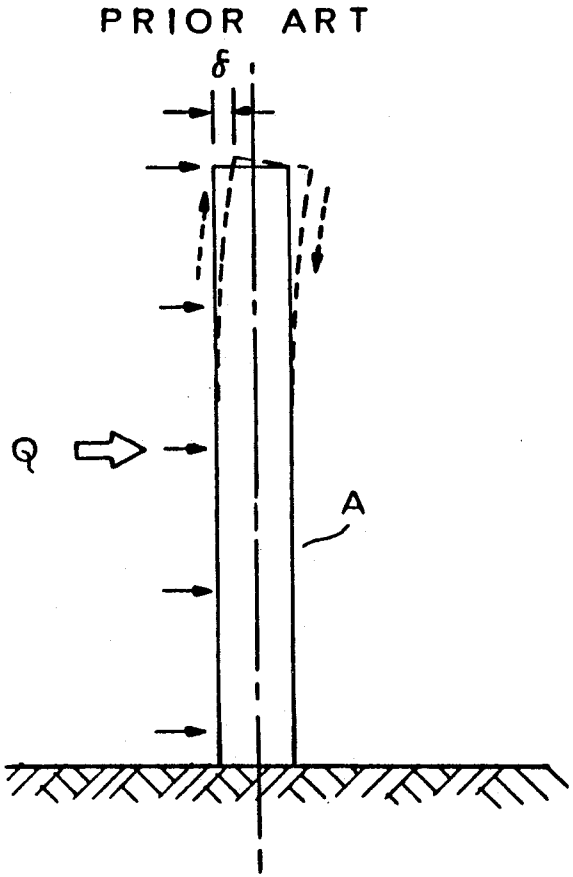
FIG. 1 PRIOR ART
FIG. 1 is a diagrammatic view illustrating the effect of wind loads on a conventional steel construction high rise tower.

Referring now to the drawing in detail, and initially to FIG. 1 thereof, a tower A of conventional steel construction is illustrated. As seen therein, when a horizontal load Q is applied to this type of tower, e.g. a wind load or a lateral movement from earthquake forces, the tower will bend in the direction of the force Q and deflect from the vertical by a distance $\delta$, which is a function of the size of the force Q. As a result of the bending which occurs, the tower is subjected to tension forces on the windward side and compression forces on the leeward side. Accordingly, such towers must be of heavy steel construction to withstand these forces. This places a practical height limitation on conventional tower construction because of expense and safety considerations.

Figure 2:
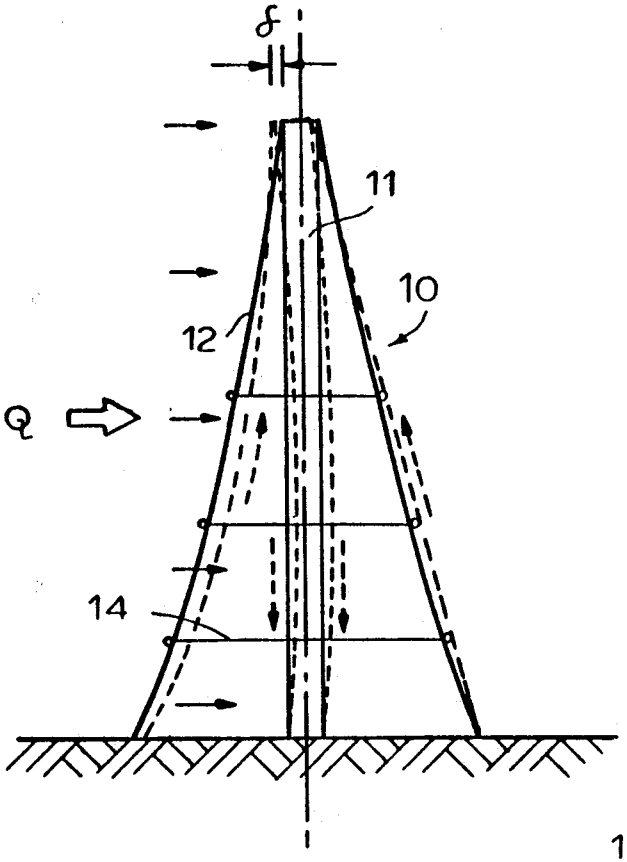
FIG. 2 is a diagrammatic view illustrating the effect of wind loads on a high rise tower constructed in accordance with the present invention.

A super high rise tower 10 constructed in accordance with the present invention is illustrated schematically in FIG. 2 for purposes of describing the different effect achieved with the construction of the invention as compared to the prior art. Although the tower will be described in detail hereinafter, as illustrated in FIG. 2, tower 10 includes a slender central core structure 11 formed of concrete modules or of structural steel having the desired height for the tower. The core is constructed to bear the compressive loads and weight of the tower. Tower 10 is surrounded by a plurality of cables 12 which extend from the corners of the tower to the ground where they are anchored to a foundation or to the base rock at the construction site. The cables 12 are surrounded by and connected to hoop cables 14 which serve to prestress cables 12 with a funicular load. The hoop cables are thus themselves prestressed with a hoop tension against cable 12. Hoop cables 14 are located at predetermined elevations along the height of the tower. Thus a tensile stress distributing cable network is formed about core 11 by the prestressed cables.

The prestressed cable network resists wind loads applied to the anchor cables 12 and maintains a balance between the hoop stress of the hoop cables 14 and compression forces applied to the core 11. The resistance of the hoop cables 14 against cables 12 maintains a solid and relatively rigid shape in anchor cables 12.

As shown in FIG. 2, when a horizontal load Q (e.g., a wind load) is applied to the super high rise tower of the invention, the anchor cables 12 at the left side in the drawing (the windward side of the tower) change shape to the shape shown by a dotted line at the left of the drawing. That is, the portion of the cable network on the windward side assumes a somewhat more arcuate shape. At the same time, the portion of the cable network on the leeward side of the tower straightens. As a result of these movements in the cable network, the upper end of the tower may be displaced by the distance $\delta$ in the opposite direction to the wind load, i.e. against the direction of wind load Q. By the prestressed arrangement of the cables, anchor cable 12 will not expand and the solid shape of the network of anchor cable 12 is restricted by the hoop stress of the hoop cables 14. The anchor cables 12 thus resist the forces introduced in the core 11 by receiving the wind load, and displacement of the core 11 with the wind are resisted by the cable network which pulls the core into the wind.

In conventional tower constructions using conventional guy wires a tower will still deflect away from the wind. With the prestressed network of the present invention however, such deflections are resisted and may be overcome. Thus, overall tower deflections $\delta$ are reduced by one third to one half of deflections occurring with conventional tower construction techniques. Accordingly, a tower of much greater height than that previously thought possible with conventional construction techniques can be achieved. The tower will have minimal displacement under wind and earthquake loads and any shaking or swaying of the tower under such loads will be rapidly dampened by the prestressed cable network.

Figure 4:
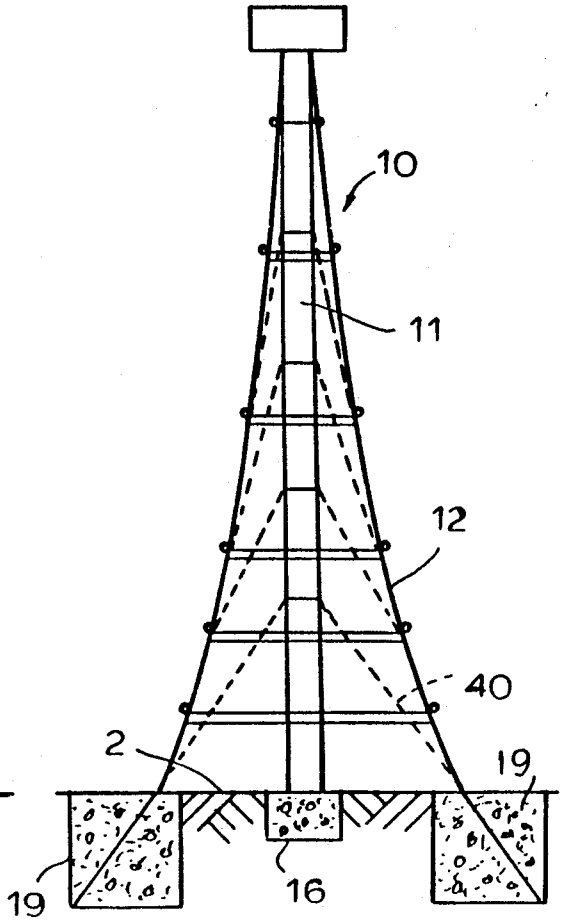
FIG. 4 is a vertical elevational view of the tower of FIG. 3.
Figure 3:
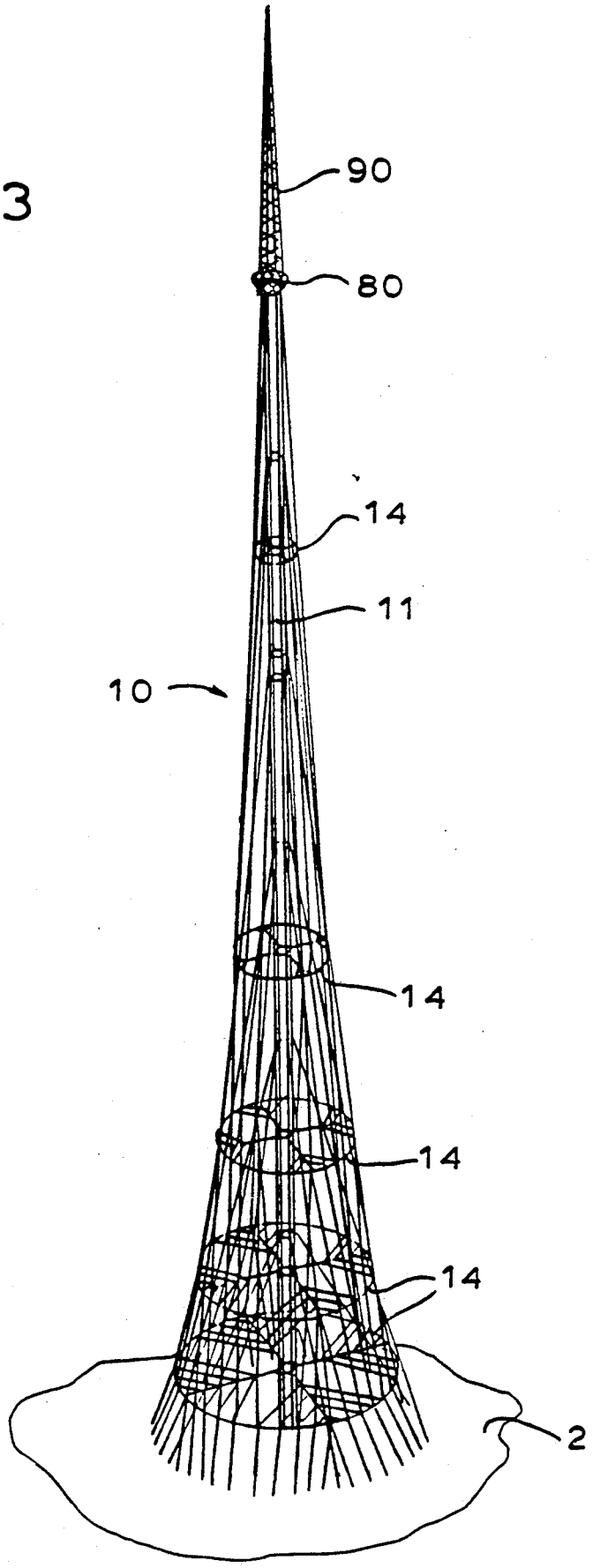
FIG. 3 is a perspective view of a super high rise tower constructed in accordance with the present invention.

A completed tower constructed in accordance with the invention is illustrated in FIG. 3, while FIG. 4 illustrates an elevational view of the tower in section. The main stages of construction of the tower are illustrated in FIGS. 5*a*–5*f*.

In this embodiment of the invention the tower is illustrated as being erected at a site having a suitable bedrock layer to which the tower is secured by concrete foundations. A foundation 16 for the core 11 is formed first, while the cables are anchored into the rock directly using rock anchors 19.

Figure 7:
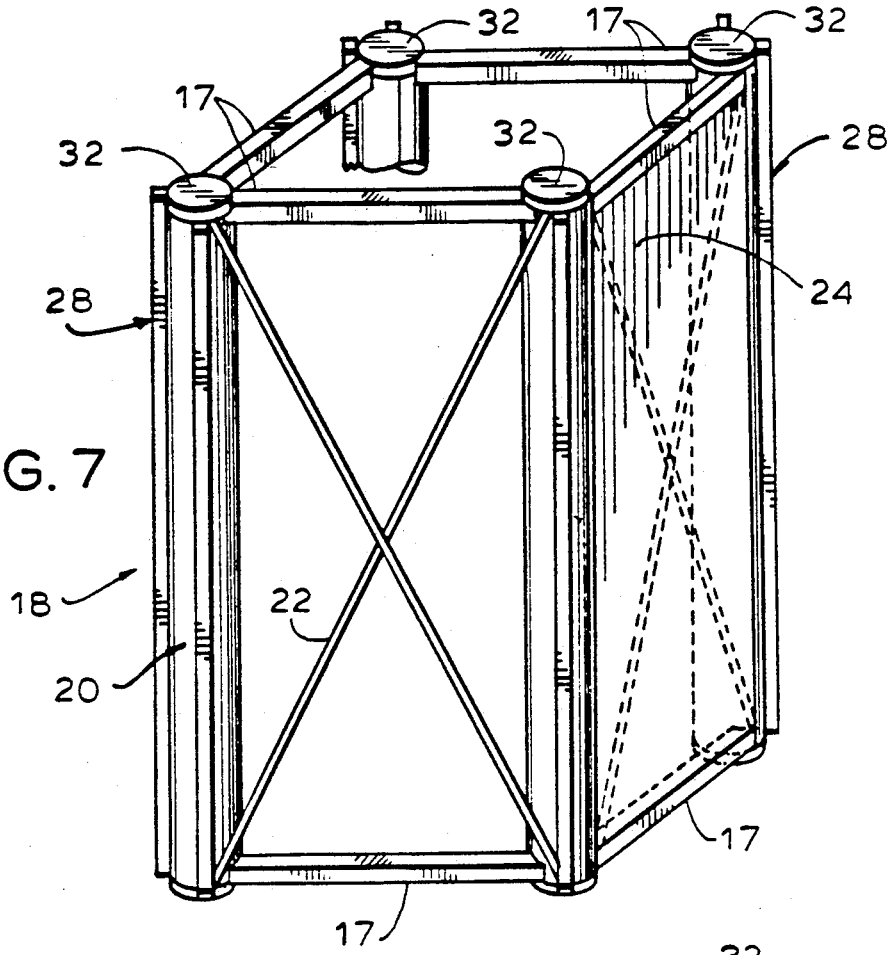
FIG. 7 ia a perspective view of a module used to form the center core of the tower.

Core 11 is preferably formed of modular construction consisting of individual core segments or modules 18 (FIGS. 7 and 8) which are adapted to be stacked on one another. Modules 18 are formed of cylindrical corner pipes or tubes 20 preferably of steel, connected by rigid tie bars or beams 17. Tubes 20 are located at the four corners of the module and serve to carry the vertical compression loads in the tower as well as the compression loads applied to the tower by the prestressed anchor cables 12 to which they are connected. The sides of each module 18 may include cross bracing members 22 and, if desired, may be covered by paneling or clapboard 24, illustrated on one side only of the module shown in FIG. 7. The cross bracing members 22 may be rigid beams, or, as illustrated in greater detail in FIG. 9, they may be in the form of a plurality of prestressed cables.

Figure 8:
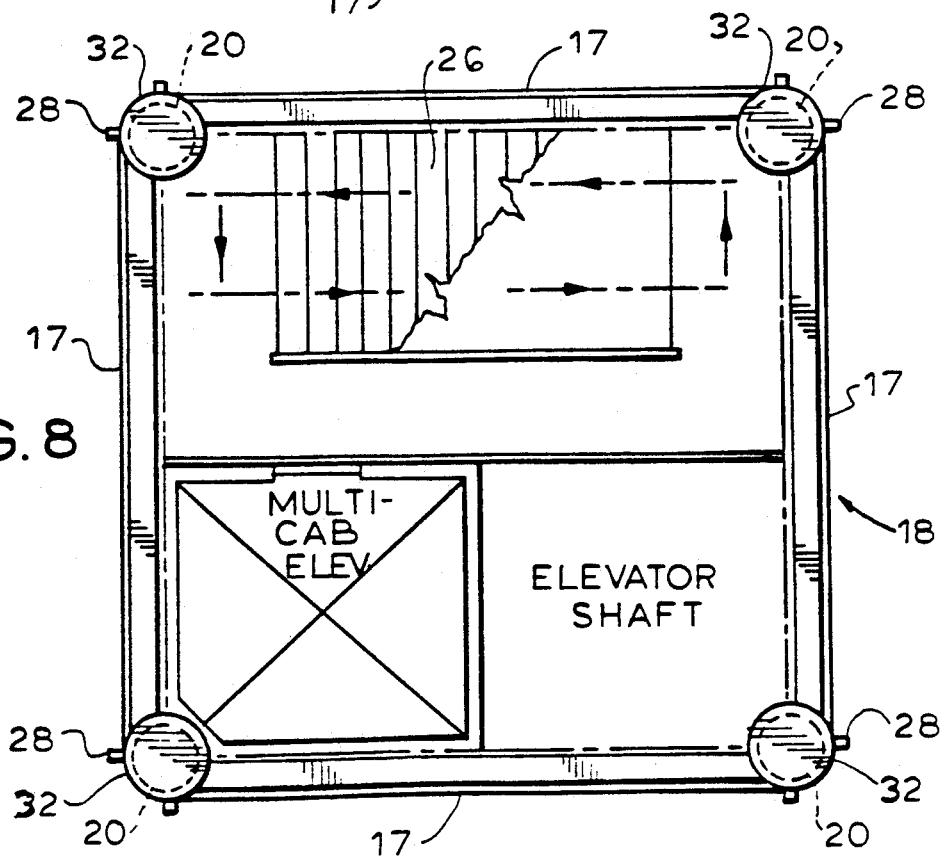
FIG. 8 is a plan view of the core of FIG. 7.

If the dimensions of the core to be built are sufficiently large the modules can have built into them before assembly interior staircases 26, hall flooring and an elevator shaft segment (see FIG. 8). Alternatively, the core modules can have a relatively small area in plan, e.g., they might be a ten foot square, and an interior stairway may be mounted on the core's interior and exterior rails supporting external elevators.

The exterior surfaces of tubes 20 are provided on their outer surfaces with rails 28 of known conventional construction. These rails permit the modules to slide along previously assembled modules as they are lifted into position.

In a typical construction procedure the first core module will be mounted in place on its foundation 16 and a vertically mobile gantry crane 42 (see FIG. 5*a*) will be mounted thereon. The next prefabricated module is then positioned adjacent the core and lifted to its elevation above the already installed core segment by sliding along the rails 28 of the core modules that are already in place. When the crane has lifted the module to the proper elevation it is then pulled laterally into place over the previously stacked modules and secured in place. The gantry crane is then moved upwardly on the core if necessary to be positioned to lift the next module into place. The use of gantry cranes in this manner is a well known technique in the construction industry and thus need not be discussed in greater detail.

The upper and lower ends of each tube 20 are closed by metal castings 32 which are fixed, as by welding or the like, to the tubes. When the modules 18 are slid into place, the castings 32 are bolted together by bolts 34 or the like (see FIG. 9) so that the core modules are assembled as a single unit.

Once a predetermined number of core modules have been assembled, the supporting network of anchor cables must also begin being connected to the core to aid in supporting it during construction.

Figure 6:
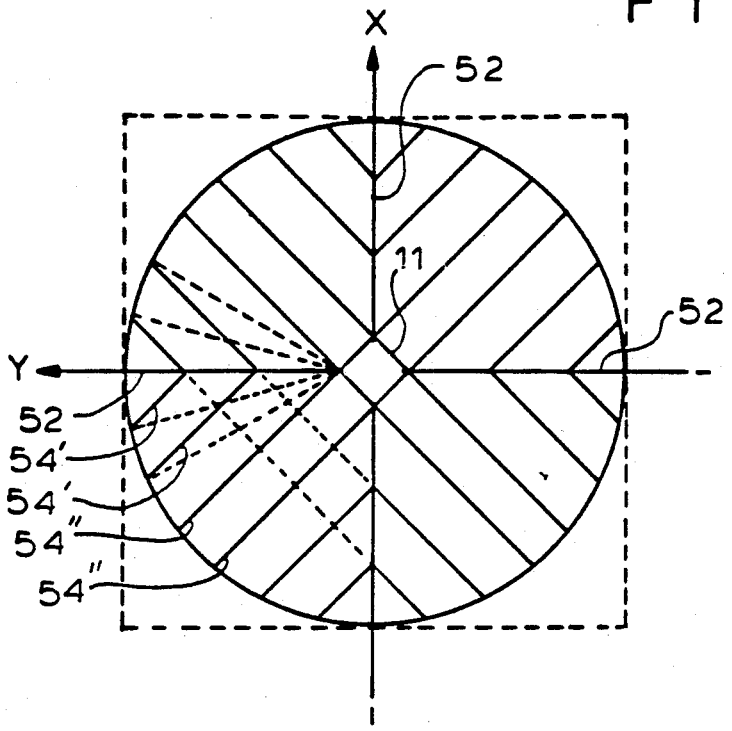
FIG. 6 is a plan view of one of the Y-cable nets used in the tower to prestress the outer cables of the tower.

The cable network surrounding the core is designed such that all of the vertical cables in the finished tower have an anticlastic curvature, while in plan, as seen in FIG. 6, the tower cross section and base define a closed curve generally conforming to a superellipse having skewed axes of symmetry as described for example in U.S. Pat. No. 3,835,599.

The first cables connected to the core are guy cables 40 secured at their upper ends to the corners of the tower and at their lower ends to the foundation 16. The upper ends of the core are connected to the castings 32 between core modules in any conventional or known manner, at a first predetermined elevation. The lower ends of the guy cables 40 are connected to the foundation in any convenient manner which will enable them to be tensioned and prestressed. These guy cables are used to stabilize the core during the initial construction stages and, during that time, act as conventional guy wires. After the anticlastic main anchor cables are connected to the core and pretensioned, these initial guy cables may be removed if desired. This initial guy cabling support is illustrated schematically in FIG. 5*a* where the initial stages of core 11 are illustrated as being stabilized by four guy wires 40 extending in straight lines from the corners of the core to the foundation. The gantry crane 42 is schematically illustrated as being attached to the topmost core module.

Figure 9:
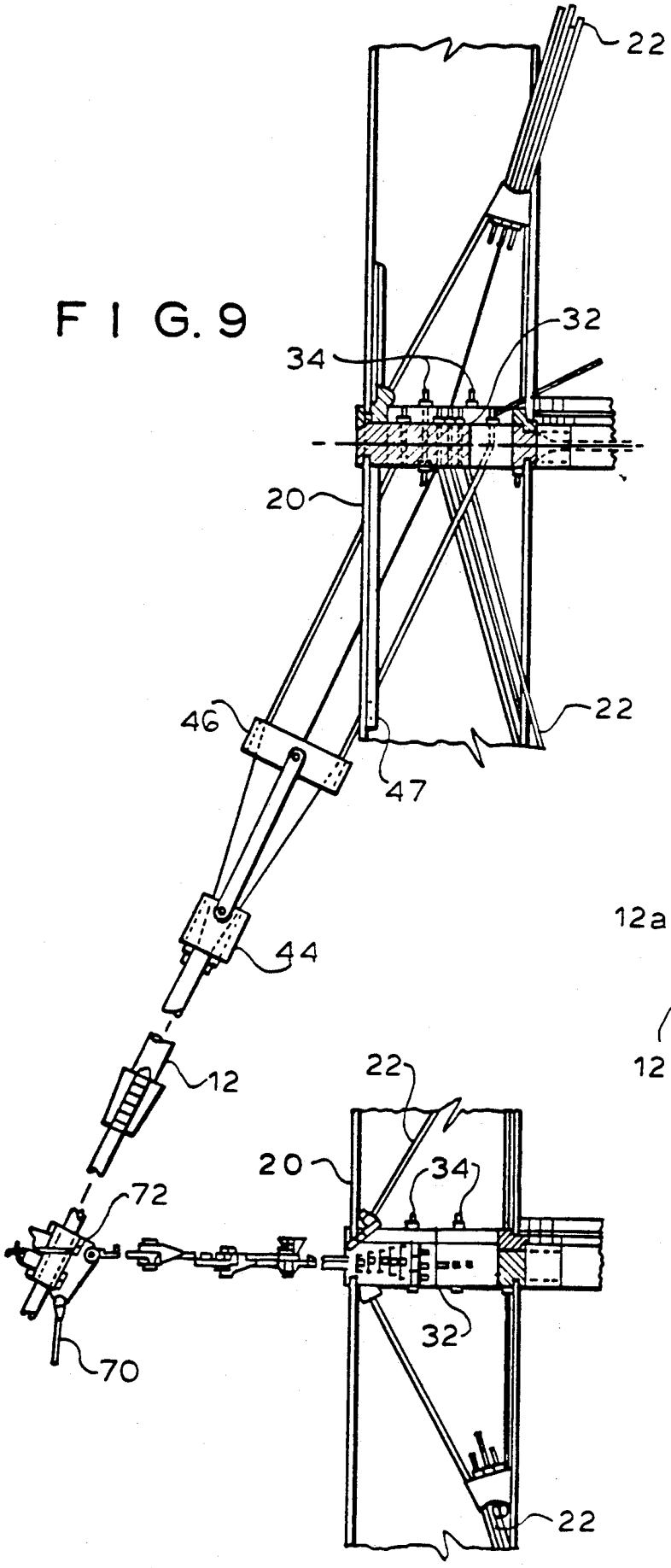
FIG. 9 is a detailed illustration of the cable connections to the center core.

With the initial core stages stabilized, the gantry crane 42 can continue lifting and putting in place additional core modules. After a predetermined number of additional modules are secured in place, as described above, the first main anchor cables 12, which actually will form the outer curved envelope of the tower are added. There are four such main cables 12, each respectively associated with one of the tower corners. The upper ends of the cables 12 are secured to the castings 32 between two modules, all at the same level. These connections may take any desired form, but one presently preferred construction is illustrated in FIG. 9. As seen therein, the upper end of cable 12 is secured in a casting 44 from which the strands of the cable separate to a guide yoke 46. From the yoke 46 the multiple cable strands enter a preformed slit 47 in its associated tube 20 of the adjacent core module and are secured in the casting using known cable securement fastening systems.

The lower end of cable 12 is splayed to form two legs 12*a* and 12*b*. The splaying may be achieved by simply separating the cable into strands to define two cable legs each containing half the original strands, or the ends of cables 12 can be mounted in a pulley or the like and a separate cable, whose ends will be anchored in the foundation, and can be passed through the pulley to form the legs 12*a* and 12*b*. (See, for example, FIG. 10). This stage of the construction is illustrated in FIG. 5*b*.

In order to prestress cables 12 (and the other anchor cables described hereinafter) a network or layer of horizontally arranged cables is located in the tower at the level of each splay of the main anchor cables. These networks of cables are built up as the main anchor cable network is erected. They consist primarily of what applicant refers to as "Y" cables, but the first cables placed in each network or layer are actually a pair of straight cables.

Figure 5A:
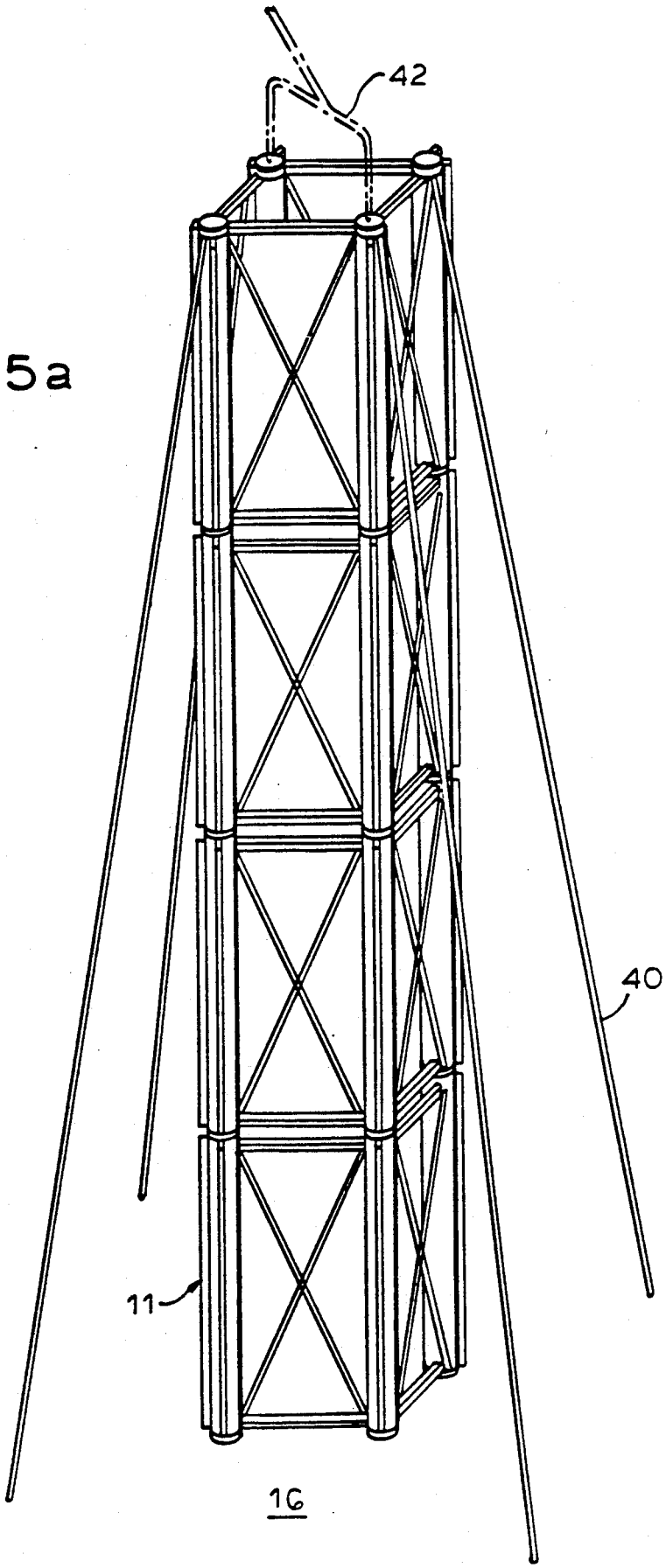
FIGS. 5*a*–5*f* are perspective illustrations of the principal sequential stages of construction of the tower of FIG. 3.
Figure 5B:
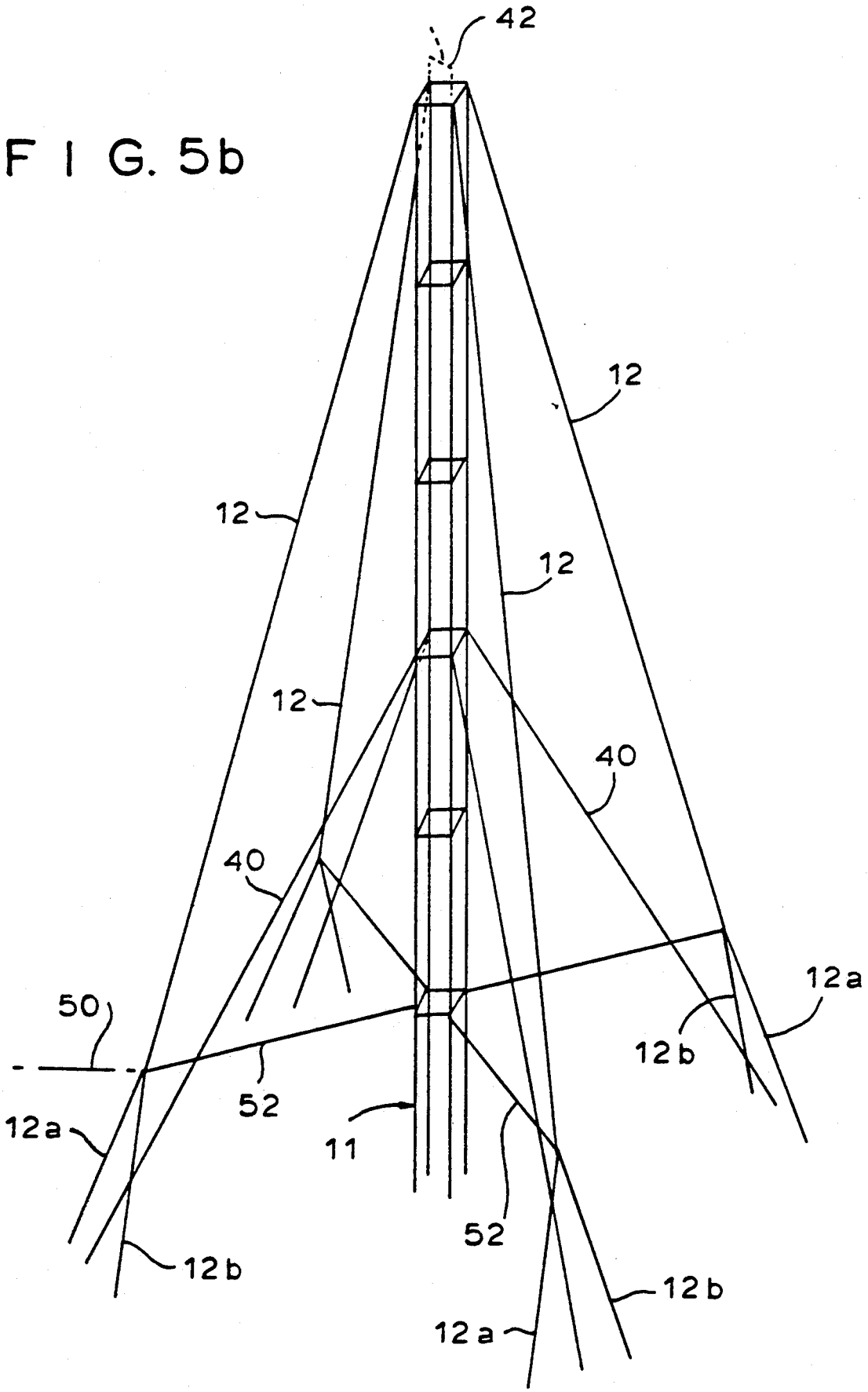

Thus, as seen in FIG. 5*b*, the first layer 50 of prestressing "Y" cables is commenced by the installation of straight cables 52 extending outwardly from the core to the point of splaying of cable 12. The points at which the main cables are splayed are selected to be at different levels than those at which main cables are attached to the core and are at levels which correspond to the joint between a pair of core modules. In this manner the inner ends of the cables 52 can be connected to the castings in the corner of the core. These connections can be made in any convenient and known manner to permit pretensioning of the cables. The opposite or outer ends of cables 52 are connected by clamps or the like at the point of splaying of cables 12. Once these connections are made, cables 52 are pretensioned by the use of turnbuckles or the like forming part of the connection system to the core castings to change the shape of cables 12 by drawing the cables in toward the core, for example, at the point of splaying. This applies a prestress to the cables 12 and moves the lower splayed part of the cables inwardly to conform to the desired shape or curvature of the finished anchor cable network. Again, this stage of the construction is illustrated in FIG. 5*b*.

Once this stage of the construction is completed, the height of the core can be increased by the addition of further core modules, as described above. When a predetermined number of further core modules are added, the next group of main anchor cables can be installed.

Figure 5C:
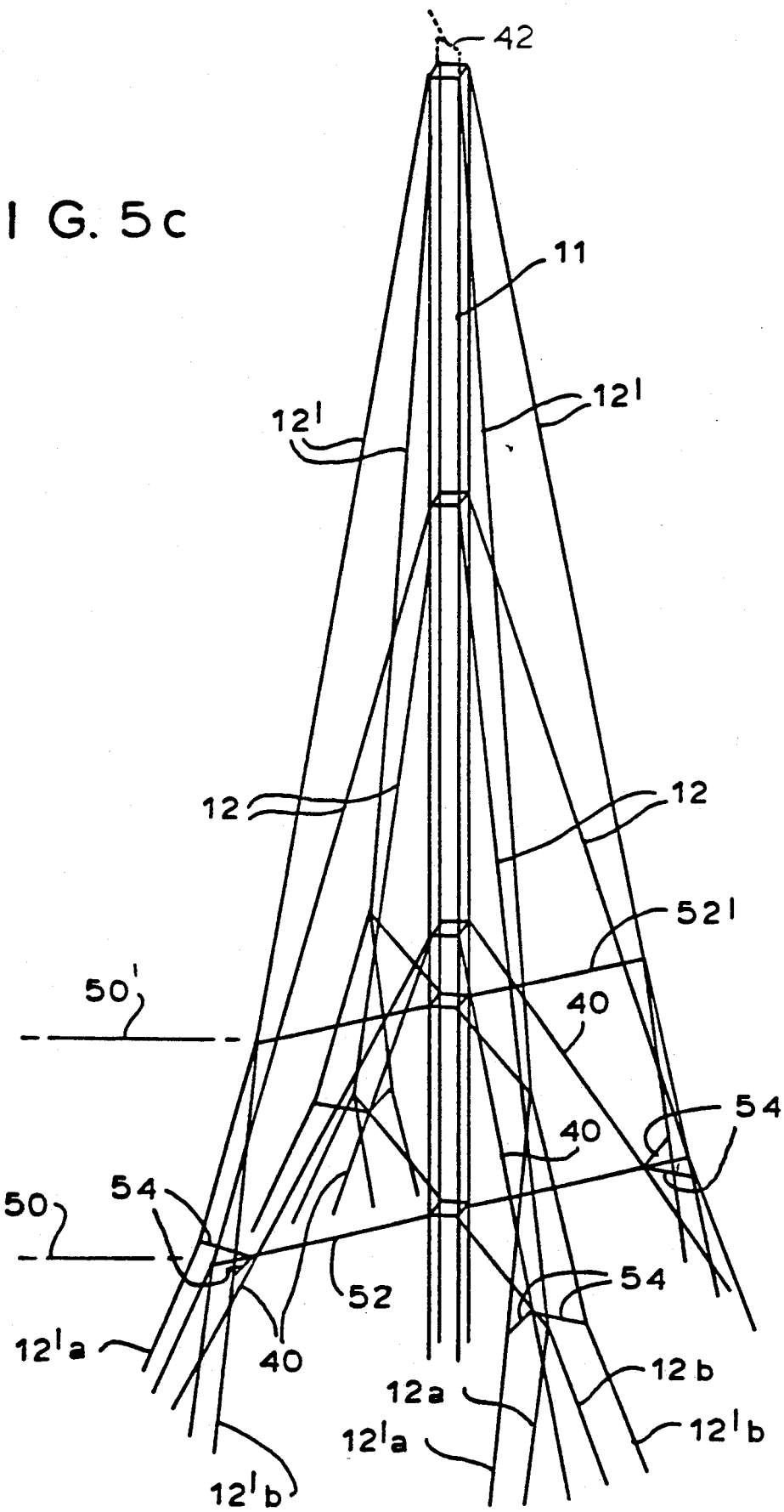

As seen in FIG. 5*c*, the next four main anchor cables 12' have their upper ends connected to the corners of the core at a higher elevation than cables 12. The upper ends of cables 12' are connected to the corner castings of their core modules in the same manner as described above for cables 12 and as illustrated in FIG. 9. The lower ends of these main cables are also splayed to form two legs 12'a and 12'b for each cable. This is done in the same manner as described above with respect to cables 12, but at a higher level. The lower ends of legs 12'a and 12'b are secured to the foundation 16.

Once cables 12' are in place, the next layer or network 50' of Y cables can be started and additional cables added to layer 50. More specifically, the layer 50' is located at approximately the elevation of the splay of cables 12' and is started with horizontal straight cables 52' corresponding to the previously described cables 50. Cables 52' are pretensioned and draw cables 12' inwardly to conform to the desired shape of the cable net. At the same stage the first four "Y" cables 54 are added to the first Y cable net 50. These Y cables have a Y configuration with the inner ends of the stems being connected to the same casting as the cables 52. The outer ends of the legs of Y cables 54 are connected respectively to one of the legs 12'a and 12'b of its associated anchor cable 12'. These Y cables are then pretensioned, in the same manner as cables 52, and draw the lower splayed ends 12'a and 12'b in towards the core so that they conform to the desired tower net shape while additionally prestressing cables 12'. This stage of the construction is illustrated in FIG. 5*c*.

Figure 5D:
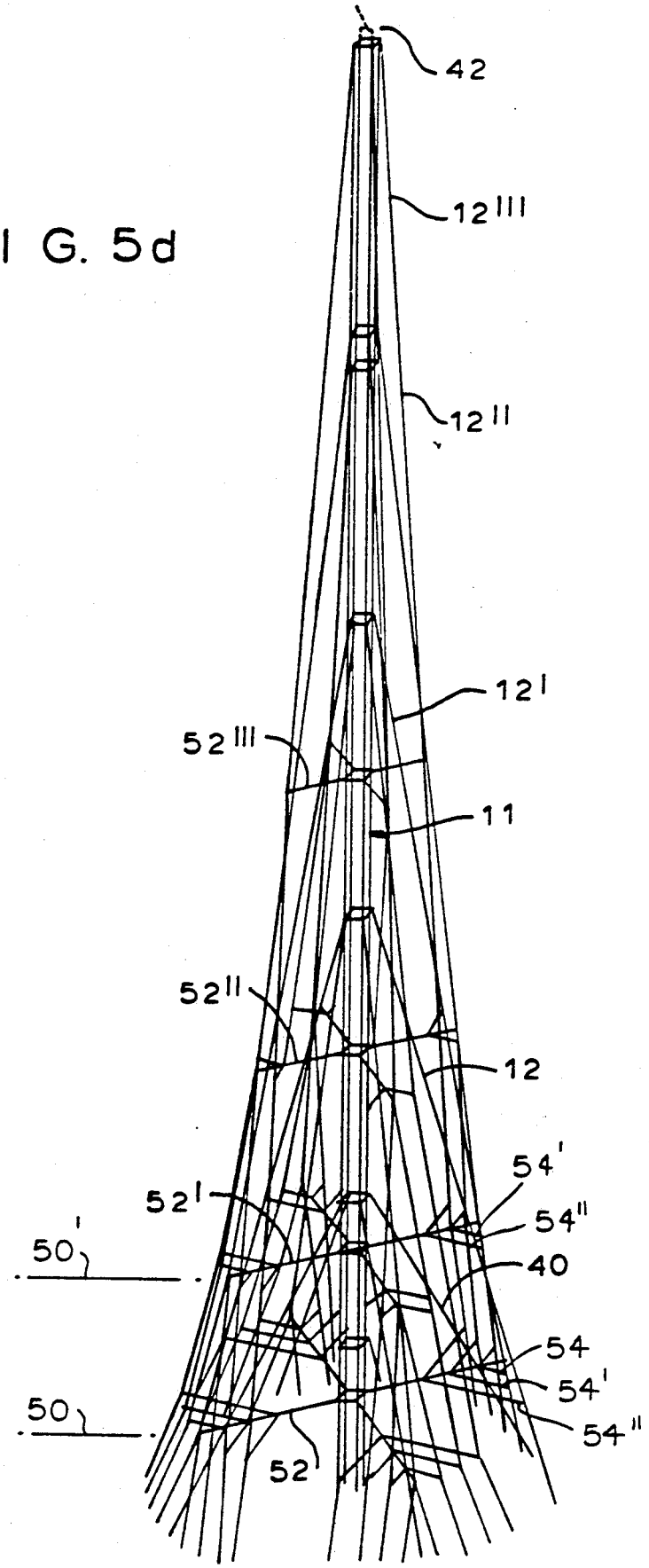
Figure 10:
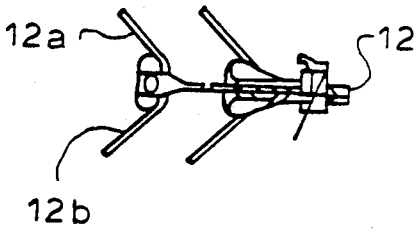
FIG. 10 is a detailed plan view of a portion of the Y-cable net of FIG. 6.

Once this stage of construction is completed the erection of the tower continues in similar additional stages in the same manner as described above. Thus, as illustrated in FIG. 5*d* (which actually illustrates two additional stages), after additional core modules have been added, four more main cables 12" are connected to the core at their upper ends. The lower ends of cables 12" are splayed, as described above, at a higher level than the splay of cables 12', to form legs 2"a and 12"b whose lower ends are, in turn, secured to the foundation 2. A third Y cable net is formed at the level of the splay of cables 12". As with the other Y cable nets this one is started with four straight cables 52". At the same time additional Y cables 54" and 54" are added to networks 50 and 50' with the ends of the Y cables being connected to the splayed legs 12"a and 12"b. The Y cables are tensioned to stress the cables 12" and conform their shape to the desired tower shape. One arrangement for connecting the Y cables to the core and the splayed anchor cable ends is illustrated in FIGS. 9 and 10. The same sequence is then repeated with the next set of anchor cables 12'''.

Figure 5E:
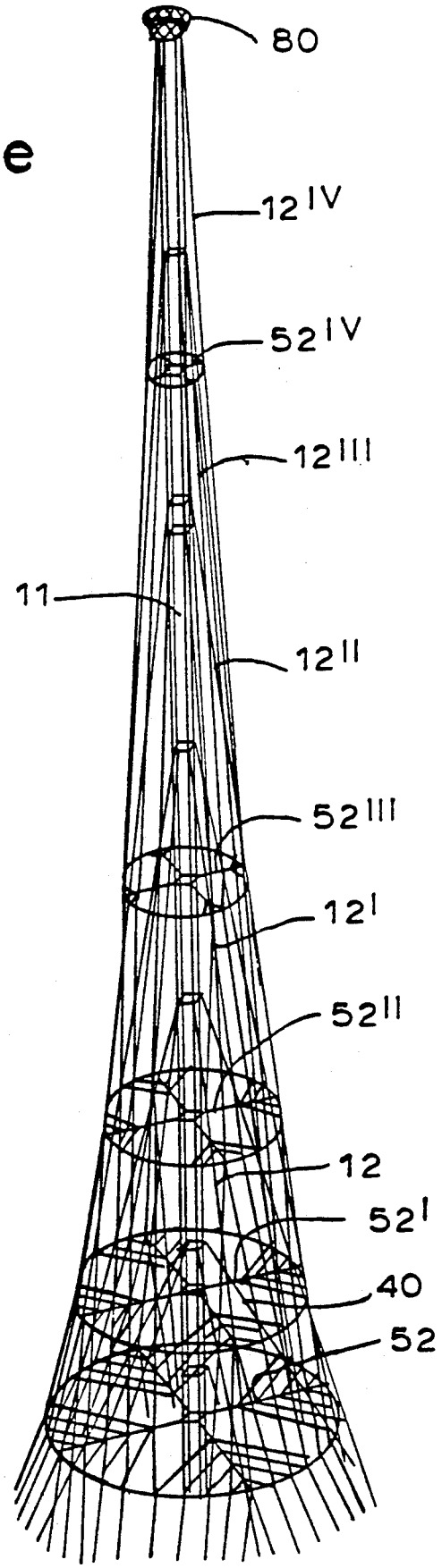
Figure 5F:
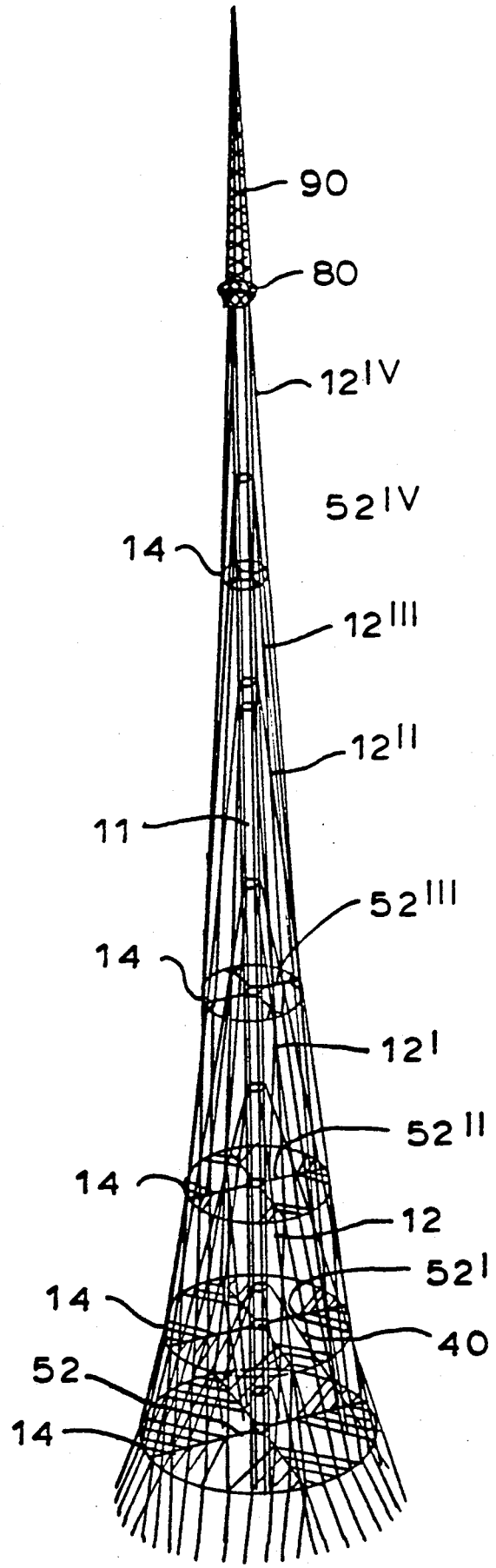

The final stages of construction are illustrated in FIGS. 5*e* and 5*f*. In FIG. 5*e* the tower core has been extended to its full height and the last set of four main anchor cables $12^{IV}$ are attached to the core. Again these cables have splayed ends, and a Y cable net $52^{IV}$ is formed at the splay to pretension the cables and move them to conform to the proper shape. At the same time additional Y cables are added to the other Y cable nets with their ends connected to the splayed legs $12^{IV}$a and $12^{IV}$b of anchor cables $12^{IV}$ to pretension the cable and conform it to the desired shape. At this stage the observation platform or the like is erected at the top of the core in any convenient manner.

Also, at this stage of the construction process the hoop cables 14 are added. These cables are secured to the anchor cables at the level of the Y cable nets and are shaped to conform to the peripheral shape of the anchor cable net at such levels. The hoop cables are secured to the anchor cables in any convenient manner. Once the hoop cables are installed, the pretension on the Y cables is relaxed slightly to allow the anchor cables to try and relax against the hoop cables which now restrain them. This serves to prestress the hoop cables and results in a funicular loading of the main cables so that the entire cable assembly works together like a membrane structure. By this arrangement, under all load conditions a proper (and substantially uniformly distributed) stress is maintained on the cable network to brace and support the core.

Figure 11:
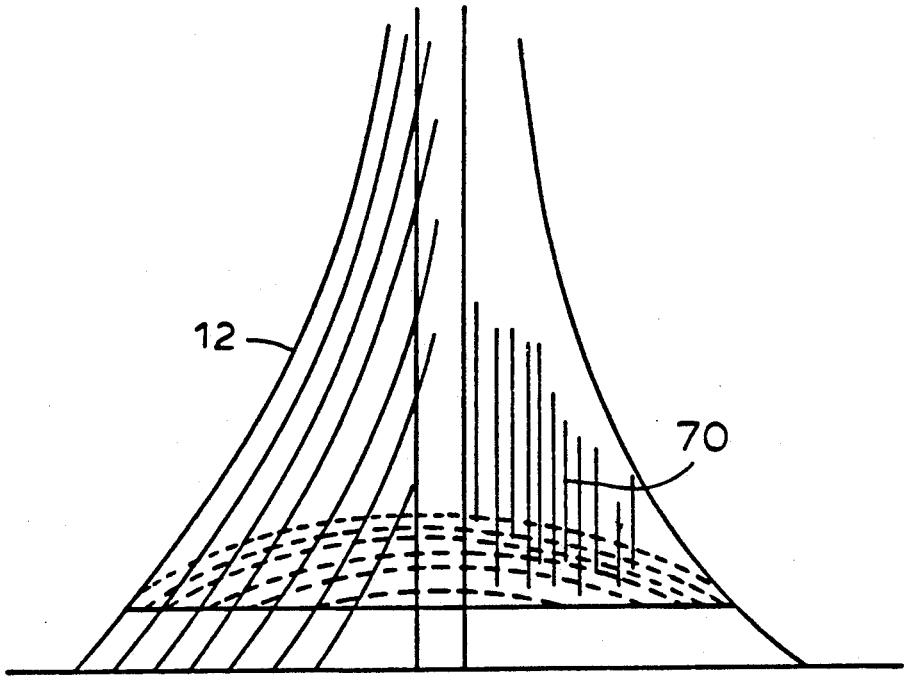
FIG. 11 is a schematic illustration of a roof structure supported in the lower portion of the tower.

If it is desired to provide an enclosure at the lower portion of the tower, a roof of any convenient construction can be built and suspended from the cable network by suspension cables 70, as seen in FIG. 11. The cables can be connected, for example, to the metal fixtures 72 used to secure the ends of the Y cables to the splayed legs of the main anchor cables.

Figure 12:
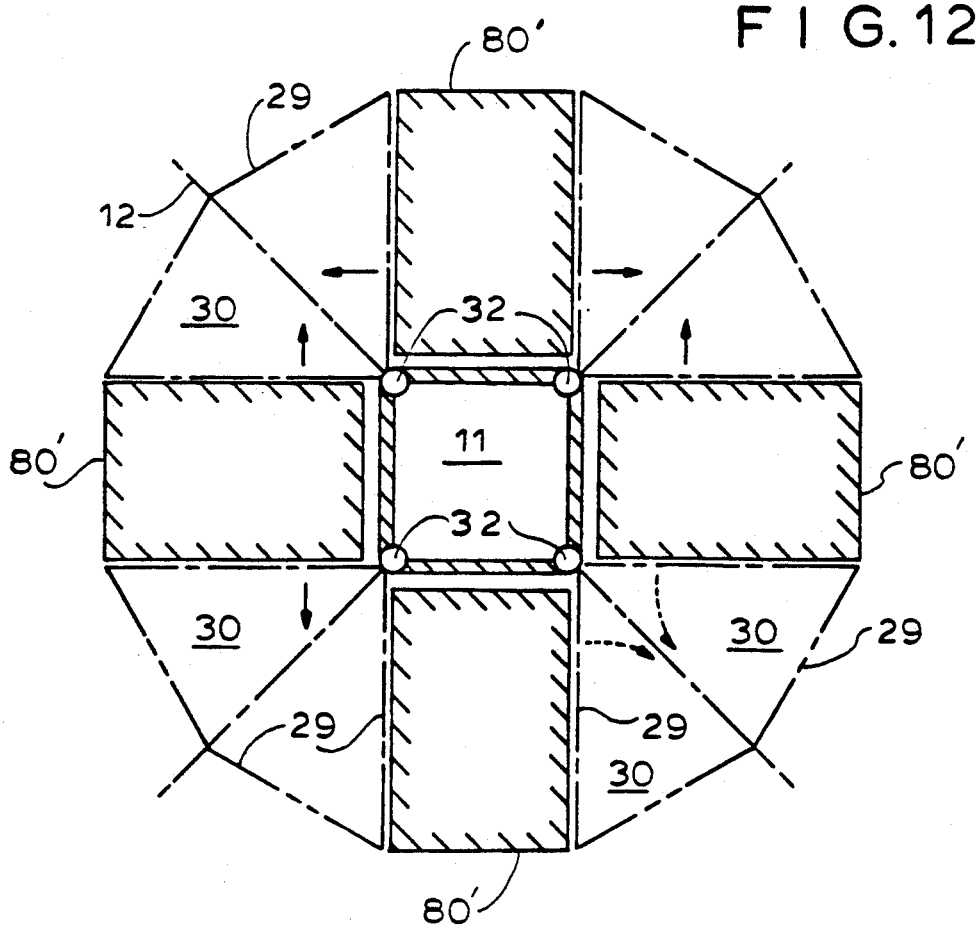
FIG. 12 is a schematic plan view illustrating the construction process for the observation platform of the tower.

In one embodiment of the invention the observation platform 80 may be formed of four prefabricated units or platforms 80' which are assembled on the ground. Then, as shown in FIG. 12, each of the four prefabricated platforms, singly or in pairs, are moved upwardly along the side rails 28 of the core. Since anchor cables 12 radiate outwardly from the corners of the core, as seen in FIG. 12, they do not interface with this movement of the platform in the upper narrow part of the tower. The prefabricated platforms 80 are fixed on the top of the core in any convenient manner. They can be joined into a single body by providing wall elements 29 at the outside of the observation platform and by building additional floor elements 30 therebetween once the prefabricated platforms are in place.

As shown schematically in FIG. 12, walls 29 can also be prefabricated and pivotally mounted on panels 80'. When being lifted the walls would be in their dotted line position and when at the top of the tower they can be pivoted to their outer solid line position. By using the prefabrication method to assemble the observation platform, a number of processes which ordinarily would have to take place at the higher position can be decreased.

Once the observation platform is completed, an antenna 90 can be erected on the top of the tower by conventional techniques to extend it to its maximum height, shown in FIG. 5*f*.

Figure 14:
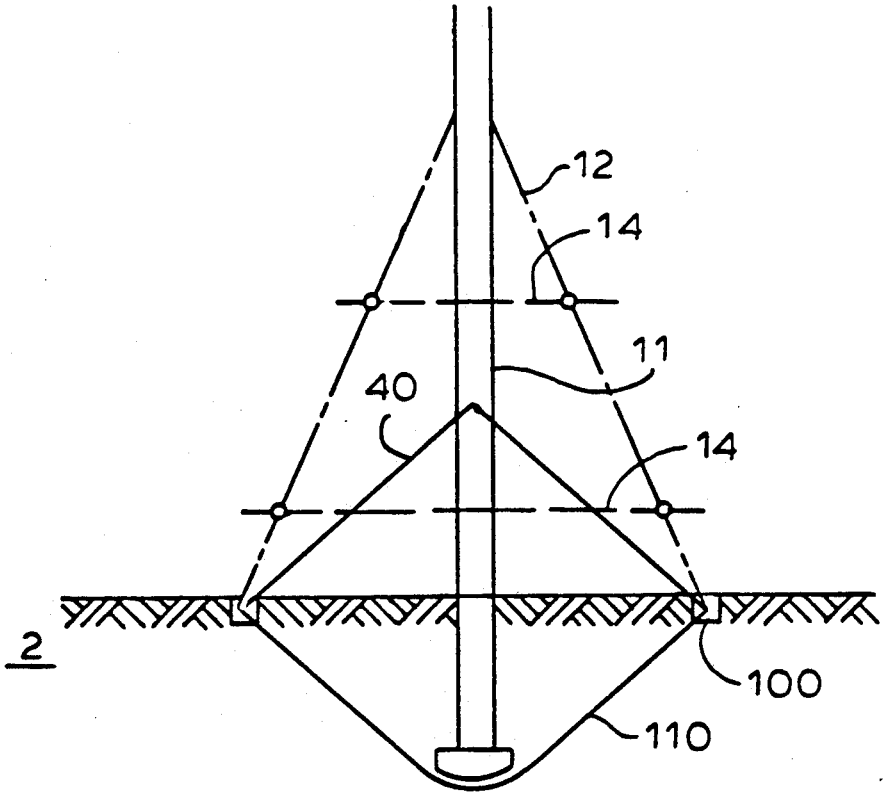
FIG. 14 is a diagrammatic view illustrating the method of construction for the tower of FIG. 13.
Figure 13:
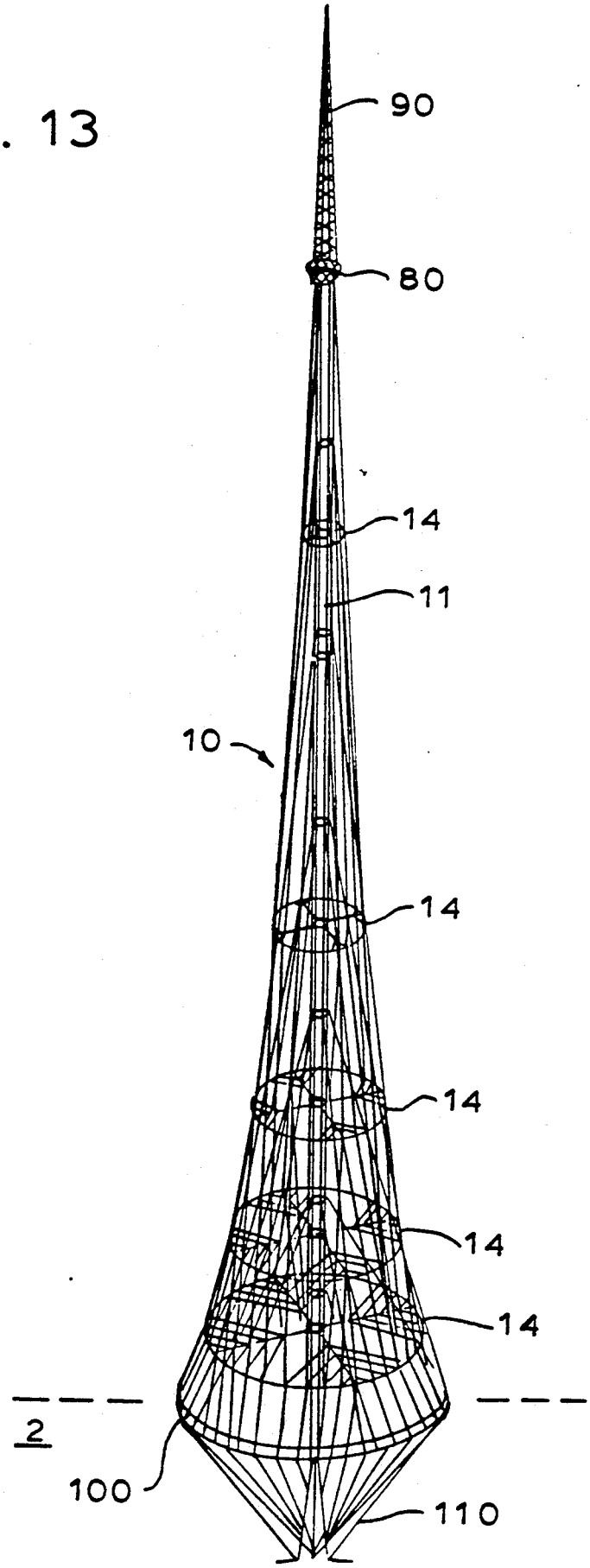
FIG. 13 is a perspective view of a tower constructed in accordance with another embodiment of the invention.

FIG. 13 illustrates another embodiment of the invention wherein the tower is constructed under a condition that soil at the surface of the ground 2 does not permit the tower to be anchored into bedrock. In this embodiment, the above ground portion of the tower is essentially the same as the previously described embodiment, but the foundation is different. As seen in FIG. 14, a compression ring 100 is horizontally set on the ground and the lower ends of the anchor cables 12 and the stay cables (if they are not removed) are fixed to the compression ring. The core is positioned at the center of the compression ring 100 and built up from a position lower than the ground surface by a predetermined depth. Prestressed balance cables 110 are provided in the base which pass through the lower end or base of the core 11 (which may be a concrete base) and are fixed to the compression ring 100 in any convenient manner. The core 11, compression ring 100, anchor cables 12 and balance cables 110 all cooperate to maintain the balance of forces on the structure in vertical and horizontal planes because of the force polygon effect of the cable net. Balance cables 110 provide the balance between the weight of the compression ring 100 and the reaction of the ground against the weight. Horizontal balance is provided by the strength of the compression ring 100. The vertical force component of the balance cable 110 maintains the balance between the downward vertical load of the core 11 and the compression load of the anchor cables 12. The overturning moment of the tower based on wind load is resisted by the reaction of the ground along the entire length of the compression ring 100.

As a result of the construction of the tower of the present invention the prestressed cable network reduces movement of the tower under wind and earthquake loads so that sway conditions at the top of the tower are considerably improved for the persons going up the tower and the force-resistance and earthquake-resistance characteristics of the tower are remarkably improved. Thus, it is possible to make the tower higher and construct various kinds of towers.

Of course, since the volume of steel used is significantly less than that of the steel frames, it is much easier to process and assemble the steel, so that the construction cost can be remarkably reduced.

Although illustrative embodiments of the invention have been described in connection with the accompanying drawings, it is to be understood that the invention is not limited to those precise embodiments and that various changes and modifications may be effected therein by those skilled in the art without departing from the scope or spirit of the invention.

What is claimed is:

1. A super high rise tower comprising a core having a predetermined height and being formed of rigid materials for receiving a compressive force, a plurality of anchor cables having upper ends fixed to said core at the outer circumference thereof for supporting said core, said anchor cables being fixed to the core at different elevations thereof, said anchor cables having lower ends fixed to the ground, means for pretensioning said anchor cables, and prestressed hoop cables horizontally provided at outer circumferences of said anchor cables, and being secured thereto, said cables forming a cable network and said prestress in the cables maintaining a balance between a compression stress of said core and the prestress of said cable network.

2. A super high rise tower comprising a core having a predetermined height and constructed to receive a compressive force built on a position under the ground surface by a predetermined depth, a compression ring horizontally provided at an outer circumference of said core and on the ground surface, balance cables provided between said compression ring and the lower end of said core, anchor cables coupling said compression ring and the terrestrial part of said core, upper ends of said anchor cables being fixed to said core for supporting said core, lower ends of said anchor cables being fixed to said compression ring, prestressed hoop cables horizontally provided at outer circumferences of said anchor cables, said cables forming a cable network, and said prestress maintaining a balance between a compression stress of said core and the prestress of said cable network.

3. A super high rise tower according to claim 1 or 2, wherein said hoop cables and said core are connected by a mesh construction of "Y" cables horizontally provided therebetween.

4. The super high rise tower according to claim 1 wherein said core is formed of a modular construction consisting of individual core segments provided at different levels of said core which are adapted to be stacked on one another at joining levels of said core segments.

5. The super high rise tower according to claim 4 wherein the lower end of each said anchor cable is splayed to form two legs at a point of splaying.

6. The super high rise tower according to claim 5 wherein each said point of splaying of said anchor cables is at a different level than the level at which said anchor cables are attached to said core and is at said joining levels of said core segments.

7. The super high rise tower of claim 5 and further including a plurality of "Y" cables being horizontally provided between said hoop cables and said core.

8. The super high rise tower of claim 7 wherein each said "Y-cable" includes a pair of horizontally extending straight cables extending outwardly from said core to generally said corresponding point of splaying of said anchor cables.

9. The super high rise tower of claim 8 wherein each said hoop cable is secured to said corresponding anchor cable at the level of said "Y" cables and is shaped to conform to the peripheral shape of said anchor cables at said levels.

10. The super high rise tower according to claim 1 wherein said hoop cables are provided at predetermined elevations along the height of said core.

11. The super high rise tower of claim 2 wherein said core, compression ring, balance cables and anchor cables all cooperate to maintain a balance of the vertical and horizontal force on the tower.

12. The super high rise tower of claim 2 wherein said core is formed of a modular construction consisting of individual core segments provided at different levels of said core which are adapted to be stacked on one another at joining levels of said core segments.

13. The super high rise tower of claim 12 wherein the lower end of each said anchor cable is splayed to form two legs at a point of splaying.

14. The super high rise tower of claim 13 wherein each said point of splaying of said anchor cables is at a different level than the level at which said anchor cables are attached to said core and is at said joining levels of said core segments.

15. The super high rise tower according to claim 13 and further including a plurality of "Y" cables being horizontally provided between said hoop cables and said core.

16. The super high rise tower according to claim 15 wherein each said "Y-cable" includes a pair of horizontally extending straight cables extending outwardly from said core to generally said corresponding point of splaying of said anchor cables.

17. The super high rise tower of claim 16 wherein each said hoop cable is secured to said corresponding anchor cable at the level of said "Y" cables and are shaped to conform to the peripheral shape of said anchor cables at said levels.

18. The super high rise tower of claim 2 wherein said hoop cables are provided at predetermined elevations along the height of said core.

19. The super high rise tower comprising a core having a predetermined height and being formed of rigid materials for receiving a compressive force, a plurality of anchor cables having upper ends fixed to said core at the outer circumference thereof for supporting said core, said anchor cables being arrayed in groups with each group being fixed to the core at a different elevation thereof, said anchor cables having lower ends fixed to the ground, means for pretensioning said anchor cables, and prestressed hoop cables horizontally provided at outer circumference of said anchor cables with each hoop cable being provided at predetermined different elevations thereof, means for bracing said core to said prestressed hoop cables, said cables forming a cable network and said prestress in said cables maintaining a balance between a compression stress of said core and the prestress of said cable network.

20. The super high rise tower of claim 19 wherein said bracing means includes a mesh construction of "Y" cables horizontally provided between said hoop cables and said core.

21. The super high rise tower comprising a core having a predetermined height and constructed to receive a compressive force, built on a position under the ground surface by a predetermined depth, a compression ring horizontally provided at an outer circumference of said core and on the ground surface, balance cables provided underneath the ground surface between said compression ring and the lower end of said core, anchor cables coupling said compression ring and the terrestrial part of said core, the upper ends of said anchor cables being fixed to said core for supporting said core, the lower ends of said anchor cables being fixed to said compression ring, said anchor cables being arrayed in groups with each group being fixed to the core at different elevations thereof, prestressed hoop cables horizontally provided at outer circumferences of said anchor cables with each hoop cables being provided at predetermined different elevations thereof, means for bracing said core to said prestressed hoop cables, said balance, hoop and anchor cables forming a cable network and prestress in the cables maintaining a balance between a compression stress of said core and the prestress of said cable network.

22. The super high rise tower of claim 21 wherein said bracing means includes a mesh construction of "Y" cables horizontally provided between said hoop cables and said core.

23. A method for building a super high rise tower comprising the steps of:

building a core of predetermined height formed of rigid materials;

supporting said core with a plurality of anchor cables with the upper ends thereof fixed to the core and the lower ends thereof fixed to the ground surface;

arranging said anchor cables in groups with each group fixed to the core at different elevations thereof; and securing horizontally arranged prestressed hoop cables at outer circumferences of said anchor cables such that said cables form a cable network wherein prestress in said cables maintains a balance between a compression stress of said core and the prestress of said cable network.

24. The method of building a super high rise tower of claim 23 and further including means for bracing said core to said prestressed hoop cables.

25. The method of building a super high rise tower of claim 24 wherein said core is braced to said prestressed hoop cables by a mesh construction of "Y" cables horizontally provided therebetween.

26. A method of building a super high rise tower comprising the steps of:

building a core of predetermined height and on a position under the ground surface by a predetermined depth;

providing a horizontal compression ring at the outer circumference of said core and on the ground surface;

constructing balance cable between said compression ring and the lower end of said core;

coupling said compression ring and the terrestrial part of said core with anchor cables;

securing upper ends of said anchor cables to said core for supporting said core;

securing lower ends of said anchor cables to said compression ring such that said anchor cables receive a tension; and providing prestressed hoop cables at outer circumferences of said anchor cables such that said cables form a cable network wherein prestress in said cables maintains a balance between a compression stress of said core and the prestress of said cable network.

27. The method of building a super high rise tower of claim 26 and further including bracing said core to said prestressed hoop cables.

28. The method of building a super high rise tower of claim 27 wherein said core is braced to said prestressed hoop cables by a mesh construction of "Y" cables horizontally provided therebetween.

* * * * *